US006373393B1

(12) United States Patent
Matsukuma et al.

(10) Patent No.: US 6,373,393 B1
(45) Date of Patent: Apr. 16, 2002

(54) FLAME DETECTION DEVICE AND FLAME DETECTION

(75) Inventors: Hidenari Matsukuma, Sagamihara; Hiroshi Shima; Masato Aizawa, both of Yokohama, all of (JP)

(73) Assignee: Hochiki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/321,184

(22) Filed: May 27, 1999

(30) Foreign Application Priority Data

Jun. 2, 1998 (JP) ..... 10-153224

(51) Int. Cl.[7] ..... G08B 17/12
(52) U.S. Cl. ..... 340/578; 250/339.15
(58) Field of Search ..... 340/578, 587; 250/339.15

(56) References Cited

U.S. PATENT DOCUMENTS 3,716,717 A * 2/1973 Scheidweiler et al. .. 340/578 X
4,691,196 A * 9/1987 Kern et al. ..... 340/578
4,866,420 A * 9/1989 Meyer, Jr. ..... 340/578
5,073,769 A * 12/1991 Kompelien ..... 340/578
5,077,550 A * 12/1991 Cormier ..... 340/578
5,495,112 A * 2/1996 Maloney et al. ..... 340/578 X
5,594,421 A * 1/1997 Thuillard ..... 340/578
5,625,342 A * 4/1997 Hall et al. ..... 340/578
5,939,721 A * 8/1999 Jacobsen et al. ..... 250/330

* cited by examiner

*Primary Examiner*—Thomas Mullen
(74) *Attorney, Agent, or Firm*—Lackenbach Siegel Marzullo Aronson & Greenspan, P.C.

(57) ABSTRACT

A fire detection device comprises a detection element to convert the infrared ray energy into the electric signal, a first extracting unit to extract the signal of a first prescribed frequency range including the flicker frequency of a fire from the output signal of the detection element, a second extracting unit to extract the signal of a second prescribed frequency range including no flicker frequency of a fire but including the frequency on the higher frequency side than that of the first prescribed frequency range from the output signal of the detection element, and a judging unit to judge a fire based on the output signal of the first extracting unit and the output signal of the second extracting unit. The fire detection device is capable of surely discriminating and detecting the flame from other infrared ray energy generation source. A band pass filter or the like need not be increased in number, and the increase in the product price can be prevented. In particular, the flame detection device is capable of rapidly judging a fire, and suitable for practical applications.

19 Claims, 11 Drawing Sheets

FLAME DETECTION DEVICE AND FLAME DETECTION

BACKGROUND OF THE INVENTION

1. Field of the Invention

The present invention relates to a flame detecting device of a detector and a flame detecting method, in which generation of a fire is automatically detected making use of the physical phenomena (heat, smoke and flame) caused by a fire.

2. Description of the Related Art

Among conventional infrared ray type flame detection devices (hereinafter, referred to as "flame detection device"), a flame detection device as illustrated in FIG. 8 is known as an example. In FIG. 8, 1 denotes a detection element, 2 denotes a frequency filter, 3 denotes a comparator, and 4 denotes an optical wavelength band pass filter. In practical applications, an amplifier, etc. for signal amplification is included, but omitted here for simplifying the description.

In the conventional flame detection device, the infrared ray energy in a monitoring area is converted into the electric signal by the detection element 1. The "prescribed low frequency component" of the electric signal is taken out by the frequency filter 2. When the level of the low frequency component exceeds the reference level, the fire detection signal is outputted. The "prescribed low frequency component" means the component including the frequency fc of the flicker (or shaking) of the infrared ray energy to be radiated from the flame, and fc is the extremely low frequency of several Hz or under.

FIG. 9 is a schematic view of how the flame burns. Generally speaking, the flame follows the growing process in which the flame is small immediately after the ignition, then, becomes gradually larger, and smaller as the combustible is exhausted, and is finally extinguished. However, when viewed in a short time, the size of the flame repeats the growth and deflation at a certain period. That is, as indicated in FIG. 9, the periodic fluctuation is repeated, wherein the burned-up flame takes in oxygen therearound and grows, while it becomes smaller for a moment once oxygen in its surrounding is reduced in amount, and then, grows again by the supply of oxygen from its outer side. It is proved that the repetitive cycle (the frequency fc) is characterized in that it is inversely proportional to the square root of the fire length for the combustible, e.g., liquid fuel. For example, the cycle is expressed by the following formula ① according to "Report on Fire-fighting Research, Vol. 53, No. 24 (1982)" (by Kunihiro Yamashita).

$$fc=k/\sqrt{L}[Hz] \quad ①$$

Where, k is a coefficient according to the kind of the fuel, and L is a value to express the quantity (fire length) of the fire. In general fire model, fc is e.g. about 2.5 Hz or 1.8 Hz. Thus, in a construction of FIG. 8, the "flame" caused by a fire can be detected if the passing frequency of a frequency filter 2 is 2.5 Hz, 1.8 Hz or each of these frequencies.

However, in the above-mentioned conventional flame detection device, the flame has been detected and judged based only on the level of the "prescribed low frequency component" including the single frequency fc given by the formula ①. Thus, for the below-mentioned reasons, errors occur with a physical phenomenon which is not related to a fire, and thus there is a problem that of reliability of the conventional flame detectors is not sufficient.

FIG. 10*a–c* is a diagram to indicate the temporal fluctuation of the infrared ray energy, where (a) denotes a flame, (b) denotes a mercury lamp, and (c) is a rotary lamp. The flame is of course an object to be monitored because the flame detection device is used for detecting the flame, and in addition, the mercury lamp is often used for illumination of roads. The rotary lamp is often used in an emergency car as well as an alarm for an entrance or an exit of a parking lot or for road construction, and for a guide of a store. These mercury lamp and rotary lamp are examples of an infrared ray energy radiation body which are seen in a daily life.

FIG. 10 indicates the output of the infrared ray energy of the flame, the mercury lamp and the rotary lamp taken out through a chopper. In FIG. 10 (*a*) the infrared ray energy of the flame flickers at the frequency in the frequency band including the extremely low frequency fc, based on the above-mentioned reason. On the other hand, the infrared ray energy of the mercury lamp is maintained at the prescribed level (neglecting the fluctuation in power supply and noise) as indicated in FIG. 10 (*b*) and the frequency of the flicker is approximately 0 Hz (only DC part). Further, the infrared ray energy of the rotary lamp is clearly accompanied by, the periodic fluctuation as indicated in FIG. 10 (*c*) and its frequency is synchronous with the revolution of the rotary lamp. The rotary lamp is diversified in kind, including one. In which one lamp is turned in one direction at the prescribed speed (about two turns a second), and one in which a plurality of lamps are turned in a synchronous or asynchronous manner, and their frequency component is also diversified, but the rotary lamp of any kind is same in that it is periodically operated.

FIG. 11*a–c* shows an observation of the infrared ray energy of the flame, the mercury lamp and the rotary lamp (e.g., the output taken out as the temperature information through the chopper) relative to the frequency axis. Similar to FIG. 10, (*a*) denotes the flame, (b) denotes the mercury lamp, and (c) denotes the rotary lamp. The axis of abscissa means the frequency, and the origin means 0 Hz (DC part). The level in the vicinity of the origin is fairly large in (a), (b) and (c), and the peak is too high to be described in a graph, and omitted due to limitations of space.

Attention is paid to the flame in (a) and the mercury lamp in (b), and it is understood that their difference is quite obvious. That is, the flame has several levels in a frequency range 6 exceeding 0 Hz while the level in a similar frequency range 7 of the mercury lamp is approximately 0. Thus, the flame can be discriminated from the mercury lamp by comparing the level of the two using the frequency fc in the conventional technology.

However, in the rotary lamp in (c), similarity to the flame in (a) is high in that it has several levels in a frequency range 8 exceeding 0 Hz. When the level of the "flame", the "mercury lamp" and the "rotary lamp" is compared with each other using the frequency fc in the conventional technology, it has been difficult to clearly discriminate the flame from the rotary lamp though the flame can be discriminated from the mercury lamp, or the mercury lamp can be discriminated from the rotary lamp. This indicates that the fire detection signal can be mistakenly outputted if, for example, an emergency car having the rotary lamp approaches a place where a conventional flame detection device is installed. It thus means that there is a technological problem which must by solved by all means from the viewpoint of the reliability of a fire-fighting device or apparatus.

A flame detection device to solve the problem is also proposed. This device made use of not the phenomenon known as the $CO_2$ resonance, but the radiation phenomenon that a peak appears in the vicinity of 4.4 μm in the spectrum distribution of the infrared ray to be irradiated from an infrared ray radiation body accompanied by the flame. This flame detection device comprises, for example, a band pass filter for center extraction to pass the infrared ray of the wavelength around 4.4 μm, and one or a plurality of band pass filters for periphery extraction to pass the infrared ray of the wavelength not including those close to 4.4 μm so that these band pass filters can be switched by a switching mechanism such as a rotary plate. (Japanese Unexamined Patent Publication No. 50-2497, Japanese Unexamined Patent Publication No. 53-44937). Alternatively, the flame detection device comprises a detection element in which a band pass filter for center extraction is arranged on its forward side, and a detection element in which a band pass filter for peripheral extraction is arranged on its forward side.

These flame detection devices judge a fire when the differential intensity level between the infrared ray passing through the band pass filter for center extraction and the infrared ray passing through the band pass filter for peripheral extraction is not less than the prescribed value. However, even by these devices, it is still difficult to completely discriminate the flame from the rotary lamp though its discrimination accuracy is improved. Further, a band pass filter of narrow-band band pass filter is expensive, and when a plurality of band pass filters are provided, the price of the whole product becomes expensive, and still worse, there is a problem that the size of the product is increased. Still further, it is necessary to provide a switching mechanism, and a plurality of detection elements, and thus the price of the product and the size of the product are therefore markedly increased.

In the above-mentioned description, the "mercury lamp" and the "rotary lamp" are illustrated as the infrared ray energy radiation body, but they are only representatives. That is, the "mercury lamp" is a representative of the infrared ray energy radiation body free from the energy fluctuation, and the "rotary lamp" is a representative of the infrared ray energy radiation body whose period in energy fluctuation has the frequency component close to the frequency fc given by the above-mentioned formula ①.

Among others, U.S. Pat. No. 4,866,420 is given as a fire detection method using the flame flicker frequency spectrum. In the U.S. Pat. No. 4,866,420, a standardized idealized spectrum curve P(f) is compared with the real time spectrum for over 2 seconds. It is then judged whether or not the real time spectrum is deviated by more than the minimum quantity from the idealized spectrum curve P(f), or deviated from the prescribed window and the maximum deviation limit, and the detected signal is a true fire or a mistake. More specifically, as indicated in its flow chart of FIG. 6, it is judged that the detected signal is a true fire when all three limits (steps 34, 37 and 38) are judged to be Yes, while it is judged to be a mistake when any of the three limits are not complied with. In the first step 34, it is judged whether or not the standard deviation is smaller than 7.5 dB in order to roughly confirm a true fire. In the next step 37, it is judged whether or not the number of the curves or parts deviated from a window of 20 dB is smaller than the 25 Hz band width of 19%. In the final step 38, it is judged whether or not two maximum deviations are smaller than 25 dB. The steps 37, 38 are run in order to clearly confirm any mistake.

In the detection method of U.S. Pat. No. 4,866,420, a true fire is judged only when all three limits of the steps 34, 37 and 38 are cleared. Thus, there are problems that the detection method is complicated, and it takes a long time to detect a fire. In particular, the judgment of the step 37 is complicated and time-consuming because it must be judged whether or not the deviation is out of the 20 dB window at a plurality of points (24 points for 2 seconds).

Because the actual detection of a fire must be highly accurate and rapidly achieved taking into consideration the rescue of human lives, the detection method of U.S. Pat. No. 4,866,420 is difficult to apply to the detection of an actual fire and is not therefore a very practical detection method.

SUMMARY OF THE INVENTION

Accordingly, it is an object of the present invention to provide a flame detection device and a flame detection method which improve the identification performance of the flame from other infrared ray energy radiation bodies which are highly similar to the infrared ray energy fluctuation of the flame, and which improves the reliability of the fire-fighting equipment, and is thus more useful for society.

It is another object of the present invention to provide the flame detection device and the flame detection method capable of preventing the increase of the product price and the size of the device by detecting a fire with excellent reliability without increasing the number of band pass filters or detection elements.

It is still another object of the present invention to provide the flame detection device and the flame detection method suitable for the practical application by rapidly judging a fire.

In order to achieve the above-mentioned objects, the flame detection device of the present invention comprises a detection element to convert the infrared ray energy into the electric signal; a first extracting means to extract the signal of the first prescribed frequency range including the flicker frequency of the infrared ray energy of the flame from the output signal of said detection element; a second extracting means to extract the signal of the second prescribed frequency range including no flicker frequency of the infrared ray energy of the flame, but including the frequency on the higher frequency side than the first prescribed frequency range from the output signal of said detection element; and a judging means to judge whether or not a fire is generated based on the output signal of said first extracting means and the output signal of said second extracting means.

Also the flame detection method of the present invention comprising a first step to extract the signal of the first prescribed frequency range including no flicker frequency of the infrared ray energy of the flame and the signal of the second prescribed frequency range including no flicker frequency of the infrared ray energy of the flame, but including the frequency on the higher frequency side than that of said first prescribed frequency range from the output signal of the detection element to convert the infrared ray energy into the electric signal; and a second step to judge whether or not a fire is generated based on two signals extracted in said first step.

Because two frequency components are extracted from the output signal of the detection element, and a fire is judged based on these two frequency components, the present invention is advantageous in that the accuracy of the judgment can be improved compared with the judgment based on only the single frequency component used by conventional technology.

Further, provision of only one band pass filter and detection element each is sufficient, and a fire detection device can be constituted in an extremely simple manner when the signal is extracted to judge a fire by a micro processor. Thus, the increase in the product price and the size of the device can be prevented.

Still further, a fire can be judged in an extremely rapid manner because the fire is judged based on only first and second frequency components. That is, the judgment can be achieved in a short time because it is unnecessary to judge whether or not the deviation is out of the 20 dB window at a large number of points like the invention in U.S. Pat. No. 4,866,420. The fire detection device suitable for the actual fire detection can be constituted.

In the device of present invention, preferably, generation of a fire is judged when the signal extracted by said first extracting means has the level of not less than the first prescribed value in said judging means, and the signal extracted by said second extracting means does not have the level of not less than the second prescribed value. Or preferably, generation of a fire is judged when the ratio of the signal extracted by said first extracting means to the signal to be extracted by said second extracting means exceeds a third prescribed value.

In the method of present invention, preferably, generation of a fire is judged when the signal of the first prescribed frequency range extracted in said first step has the level of not less than the first prescribed value, and the signal of the second prescribed frequency range extracted in said first step does not have the level of not less than the second prescribed value in said second step. Or preferably, generation of a fire is judged when the ratio of the signal of the first prescribed frequency range extracted in said first step to the signal of the second prescribed frequency range exceeds the third prescribed value in said second step.

These judgments are advantageous in that, for example, the "rotary lamp" to show the trend of the fluctuation in the infrared ray energy similar to that of the flame, is not misidentified as the "flame".

Further, in the device of present invention, preferably, said first extracting means and said second extracting means may analyze the frequency of the signal and extract the signal using a digital filter, a Fast Fourier Transformation method, or a maximum entropy method. Also, in the method of present invention, preferably, the frequency of the signal is analyzed and the signal is extracted using a digital filter, a Fast Fourier Transformation method or a maximum entropy method in said first step and said second step.

In this device and method, the present invention is advantageous in that the desired characteristic can be freely obtained at a low cost.

Still further, the fire can be judged more rapidly, and the flame can be more readily and accurately detected.

Still preferably, in the device and the method of present invention, said first prescribed frequency range is set up to include no DC part of the output signal of said detection element.

In this device and method, signal concerning infrared ray energy radiation body without fluctuation in infrared ray energy, for example, the "mercury lamp" can be eliminated, thus fire detection is achieved easily and with certainty.

Still preferably, in the device and the method of present invention, said second prescribed frequency range includes at least multiple harmonic frequency of each frequency of said first prescribed frequency range.

In this device and method, frequency range which includes higher harmonic frequency of said first prescribed frequency range is set to said second range, artificial infrared ray energy radiation body with the fluctuation in the infrared ray energy, for example, the "rotary lamp" can be discriminated from that of an actual fire.

Still preferably, in the device and the method of present invention, said first prescribed frequency range is 0.5 Hz to 8.0 Hz, and said second prescribed frequency range is 8.5 Hz to 16.0 Hz. Or, preferably, said first prescribed frequency range is 0.25 Hz to 8.0 Hz, and said second prescribed frequency range is 8.25 Hz to 16.0 Hz.

These frequency ranges are theoretically and experimentally determined, and capable of most rapidly and correctly detecting a general flame.

Further, as described above, the device of present invention preferably comprises a detection element to convert the infrared ray energy into the electric signal; a first extracting means to extract the signal of a first prescribed frequency range of 0.5 Hz to 8.0 Hz including no DC part of said output signal but including the flicker frequency of the infrared ray energy of the flame from the output signal of said detection element by the Fast Fourier Transformation method; a second extracting means to extract the signal of a second prescribed frequency range of 8.5 Hz to 16.0 Hz including no flicker frequency of the infrared ray energy of the flame, but including the frequency on the higher frequency side than that of said first prescribed frequency range from the output signal of said detection element by the Fast Fourier Transformation method; and a judging means that a fire is generated when the signal extracted by said first extracting means has the level of not less than the first prescribed value, and the signal extracted by said second extracting means does not have the level of not less than the second prescribed value.

Also, as described above, the method of present invention preferably comprises a first step to extract the signal of a first prescribed frequency range of 0.5 Hz to 8.0 Hz including no DC part of the output signal but including the flicker frequency of the infrared ray energy of the flame and the signal of a second prescribed frequency range of 8.5 Hz to 16.0 Hz including no flicker frequency of the infrared ray energy of the flame but including the frequency on the higher frequency side than,that of said first prescribed frequency range from the output signal of a detection element to convert the infrared ray energy into the electric signal by the Fast Fourier Transformation method; and a second step to judge that a fire is generated when the signal of a first prescribed frequency range extracted in said first step has the level of not less than the first prescribed value, and the signal of the second prescribed frequency range extracted in said first step does not have the level of not less than the prescribed value.

DESCRIPTION OF THE PREFERRED EMBODIMENTS

First to fifth embodiments of the present invention are described referring to drawings as the embodiments applied to an infrared ray flame detection device (hereinafter, referred to as "flame detection device").

Figure 1:
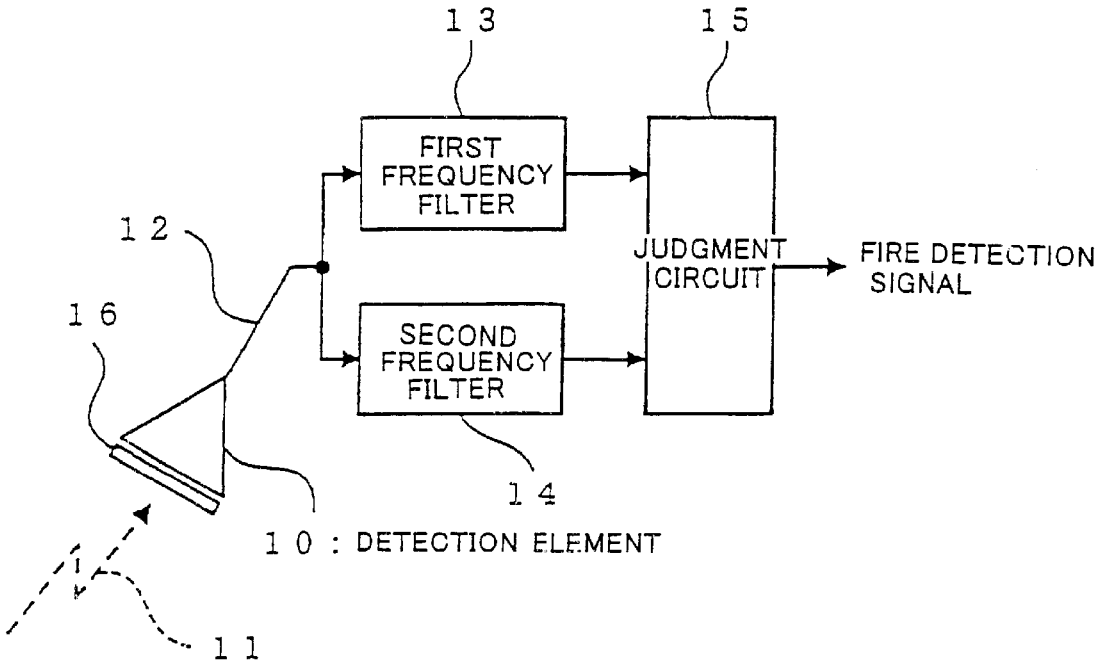
FIG. 1 is a conceptual view of a first embodiment of the present invention.

FIG. 1 is a conceptual view of the flame detection device in the first embodiment. In the figure, 10 denotes a detection element (not specified, for example, an element using a pyroelectric sensor) to convert the infrared ray energy 11 into the electric signal 12, 13 denotes a first frequency filter, 14 denotes a second frequency filter, 15 denotes a judgment circuit, and 16 denotes an optical wavelength band pass filter.

The first frequency filter 13 has a characteristic to selectively pass the signal in the first prescribed frequency range $f_{CL1}$–$f_{CH1}$ (hereinafter, referred to as "first frequency range A") around the frequency corresponding to the flicker frequency (the frequency fc in the beginning) of the infrared ray energy of the flame. The second frequency filter 14 has a characteristic to selectively pass the signal in the second prescribed frequency range $f_{CL2}$–$f_{CH2}$ (hereinafter, referred to as "second frequency range B") on the higher frequency side adjacent to the first frequency range. The first frequency range A ($f_{CL1}$–$f_{CH1}$) is, for example, in a range of 0.5–8.0 Hz, and the second frequency range B ($f_{CL2}$–$f_{CH2}$) is, for example, in a range of 8.5–16.0 Hz.

These frequency ranges have been theoretically and experimentally determined, and are capable of most rapidly and correctly detecting a general flame.

More specifically, the first frequency range of 0.5–8.0 Hz includes both flicker frequencies fc=2.5 Hz and 1.8 Hz under a general condition of the above-mentioned Fire-fighting Certification Standards, and is determined taking into consideration the variance of the frequency due to the difference from other fire conditions and the temporal transition trend of the flicker frequency (the trend in which the flicker frequency becomes smaller as the time is elapsed). This determination is based on the results of several experiments by application, which shows the essential flicker frequency of fire is within 8.0 Hz. The second frequency range of 8.5–16.0 Hz does not include the flicker frequency of fire, and is determined taking into consideration the variance of the frequency similar to the first frequency range, and the temporal transition trend.

The frequency range is variable so as to be adapted to the environment, etc.

Figure 2:
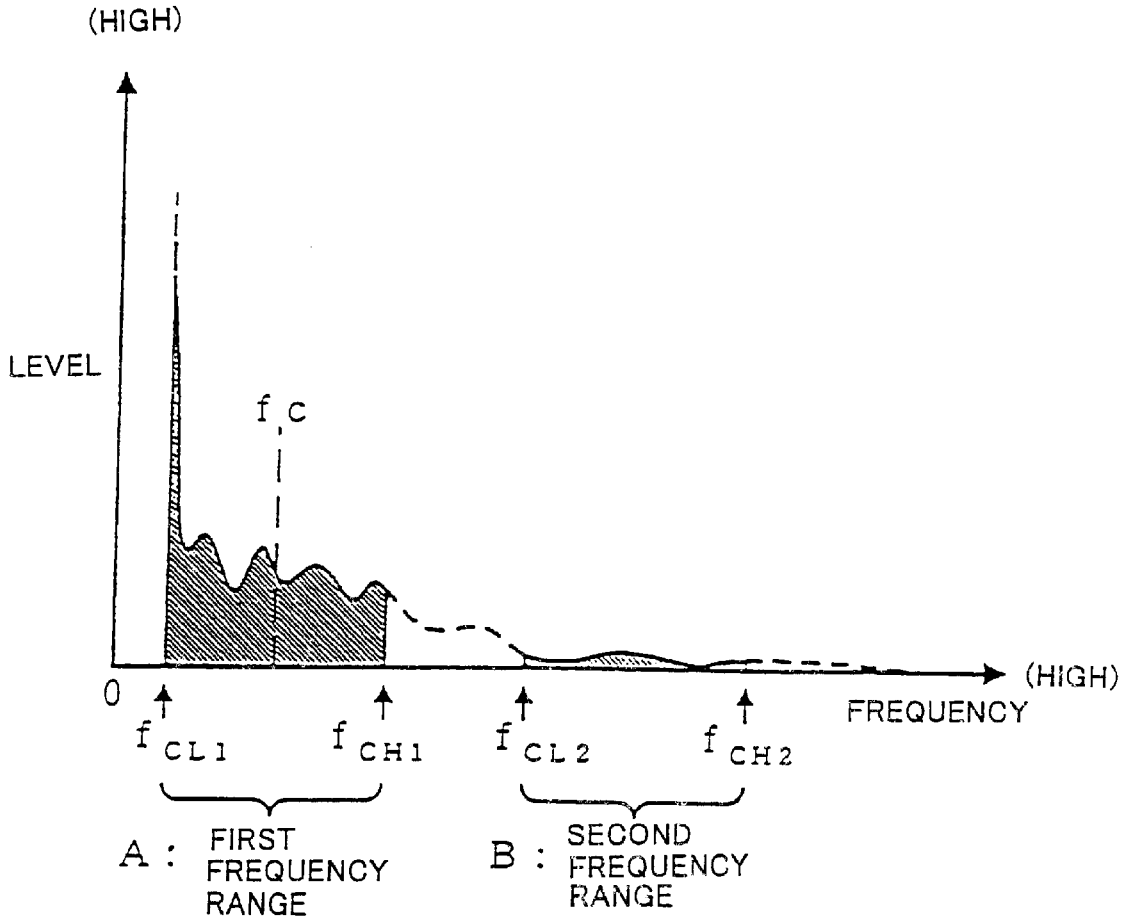
FIG. 2 is a graph to indicate the relationship between the signal intensity (obtained by observing the infrared ray from the combustion flame and analyzing the frequency) and the frequency.

FIG. 2 is a graph to indicate the relationship between the signal intensity (obtained by observing the infrared ray from the combustion flame and analyzing the frequency) and the frequency, and the axis of ordinate means the level of the passing signal, and the axis of abscissa means the frequency. In FIG. 2, the crosshatching close to the origin of the frequency axis shows the signal in the first frequency range A passing through the first frequency filter 13. In FIG. 2, the crosshatching on the right side shows the signal in the second frequency range B passing through the second frequency filter 14. As shown in FIG. 2, signal level of a flame fire is high in the first frequency range A, on the other hand, signal level is hardly obtained in the second frequency range B, and also the signal in the range B is extremely lower than signal in the range A. In the figure, the first frequency range A is discontinuous from the second frequency range B, but they can be continuous, or a part of them can be overlapped on each other. The second frequency range B need not be limited to one frequency range, but may be a plurality of frequency ranges. What is important is that the first frequency range A includes the flicker frequency (the frequency fc in the beginning) of the infrared ray energy of the flame, and the second frequency range B does not include the frequency fc, but includes the frequency higher than that in the first frequency range A. Other items can be appropriately regulated according to the requests for the detection performance, etc.

Figure 3:
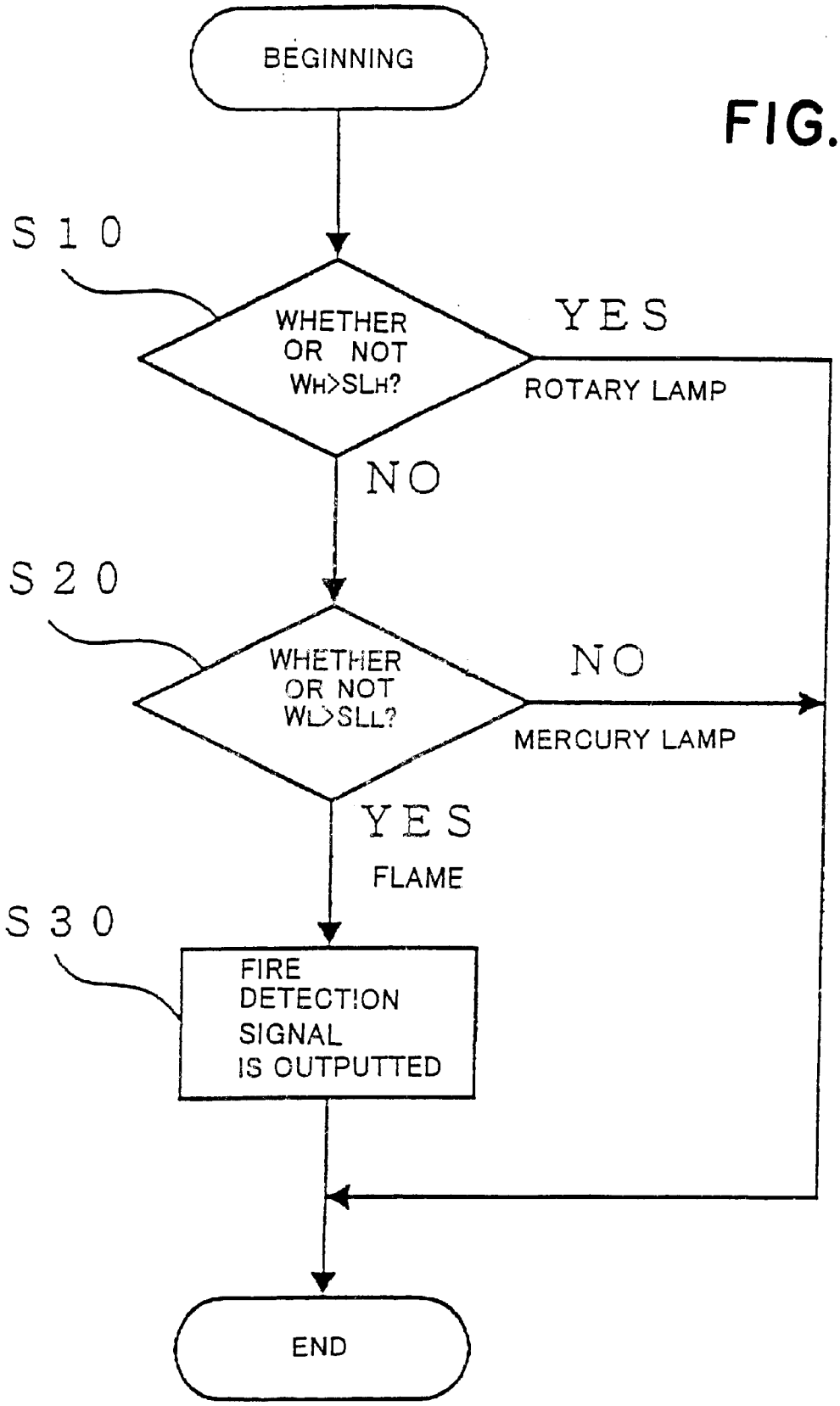
FIG. 3 is a flowchart suitable for application to a judgment circuit.

The judgment circuit 15 is a part to judge a fire based on the signal of the first frequency range A and the signal of the second frequency range B, and its preferable algorithm of judgment is described in FIG. 3. The algorithm in FIG. 3 is described by a flowchart, but it does not necessarily mean only the restrictive application to the software processing.

The optical wavelength band pass filter 16 sets the passing characteristic of the wavelength band around the wavelength of 4.4 $\mu$m having a high peak through the $CO_2$ resonance radiation specific to the flame, and is provided as necessary.

In FIG. 3, $W_H$ dontoes the signal level integrated value of the seconc frequencey range B on the higher frequency side, and $W_L$ denotes the signal level integrated value of the first frequency range A on the lower frequency side. The mean value may be used in place of the integrated value. In brief, they may be the generalized energy value of the signal level from which the noise component in each frequency range is removed.

In the flowchart, whether or not $W_H$ exceeds the prescribed threshold $SL_H$ (S10), the level of $SL_H$ is an appropriate level which is higher than $W_H$ of the flame, and is lower than $W_H$ of other infrared ray energy radiation body with the fluctuation in the infrared ray energy similar to the flame, for example, the "rotary lamp". Thus, when the judgment is YES in S10, the infrared ray energy radiation body can be identified as another infrared ray energy radiation body with fluctuation in the infrared ray energy similar to the flame, for example, the "rotary lamp", and in this case, no fire is present, and the flow is completed.

On the other hand, if the judgment is NO in S10, it is proved that the infrared ray energy radiation body is not the "rotary lamp". However, in only this judgment, it can not be clearly discriminated whether the infrared ray energy radiation body is the "flame" or not. For example, it can not be discriminated whether the body is the flame or other infrared ray energy radiation body without fluctuation in the infrared ray energy, for example, the "mercury lamp". Thus, for the discrimination, it is judged (S20) whether or not $W_L$ exceeds the prescribed threshold $SL_L$. The level of $SL_L$ is an appropriate level which is lower than $W_L$ of the flame, and higher than $W_L$ of other infrared ray energy radiation body without fluctuation in infrared ray energy, for example, the "mercury" lamp. Thus, if the judgment is NO in S20, the infrared ray energy radiation body is identified to be other infrared ray energy radiation body such as a radiation body with the infrared ray energy of only DC part, for example, the "mercury" lamp, and the flow is completed because no fire is present in this case. On the other hand, if the judgment is YES in S20, the infrared ray energy radiation, body is one with $W_L$ exceeding $SL_L$ i.e., the flame, and the fire detection signal is outputted (S30) and the flow is completed because fire is present.

As mentioned above, in the first embodiment, the output signal of the infrared ray energy detection element 10 is passed through two frequency filters (the first frequency filter 13 and the second frequency filter 14) to extract the representing signal ($W_L$) of the first frequency range A around the frequency corresponding to the flicker frequency (the frequency fc in the beginning) of the infrared ray energy of the flame, and the representing signals ($W_H$) of the second frequency range B on the higher frequency side adjacent to the first frequency range A, and the fire is judged based on these two representing signals ($W_L$, $W_H$) by the judgment circuit 15. Thus, compared with the judgment based on the single signal component, a remarkably advantageous effect of improving the identification performance of other infrared ray energy radiation body with fluctuation in infrared ray energy similar to the flame, for example, the "rotary lamp" in the beginning from the "flame", can be obtained.

The first embodiment of the present invention is of course not limited to the above-mentioned example, and diversified modifications are possible in the scope of the idea.

Figure 4:
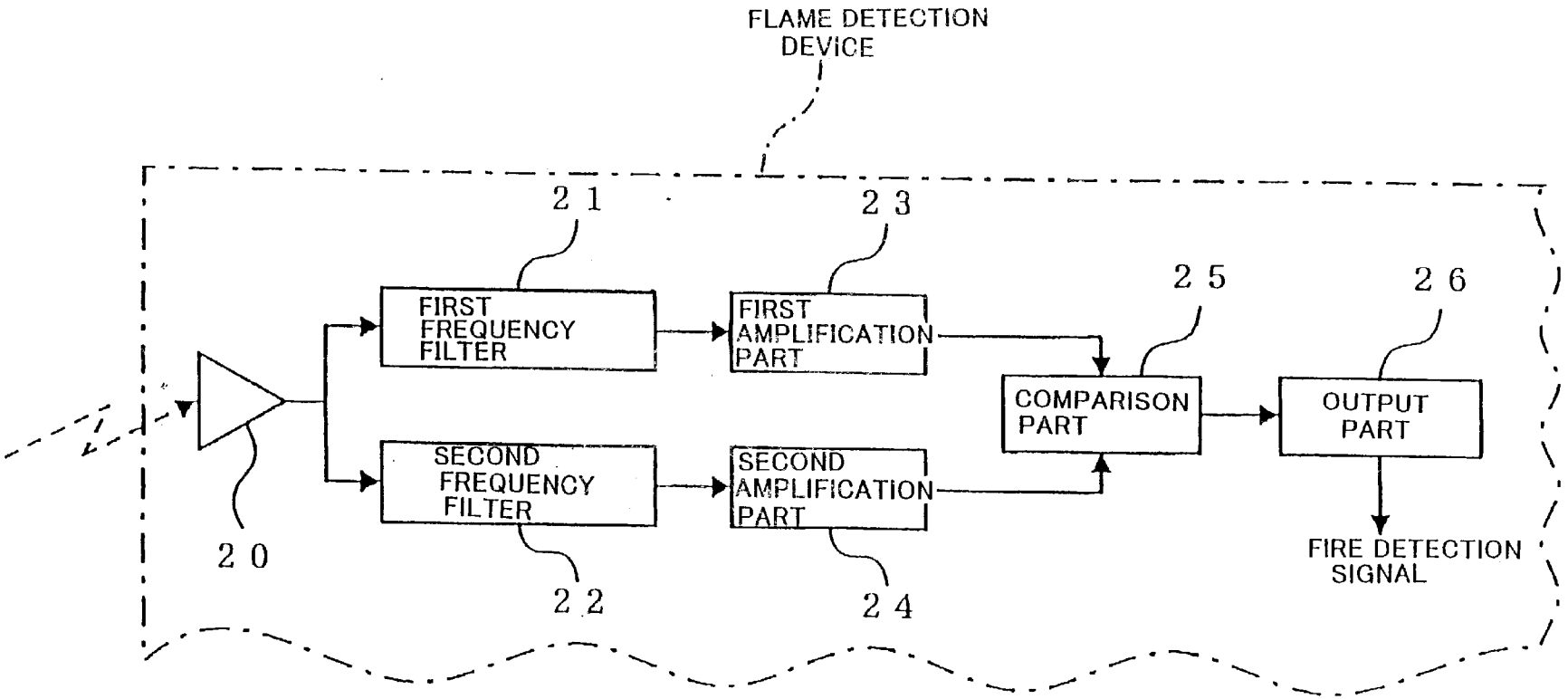
FIG. 4 is a conceptual diagram of a second embodiment.

The second embodiment of the present invention described in FIG. 4, is described.

The flame detection device of the present embodiment is provided with the detection element 20, the first frequency filter 21 and the second frequency filter 22 similar to those in the above-mentioned embodiment, and in addition, provided with a first amplification part 23 to amplify the signal ($W_L$) of the first frequency range A to be taken out of the first frequency filter 21, a second amplification part 24 to amplify the signal ($W_H$) of the second frequency range B to be taken out of the second frequency filter 22, a comparison part 25 to judge a fire based on the signals ($W_L$, $W_H$) of these two frequency ranges, and an output part 26 to generate the fire detection signal according to the result of judgment.

The comparison part 25 judges a fire when the ratio of $W_L$ to $W_H$ ($W_L/W_H$) exceeds the prescribed threshold (the third prescribed value). The "flame" and the mercury lamp, and "the flame" and the "rotary lamp" can also be discriminated from each other, respectively. This is because the ratio $W_L/W_H \geqq 4.0$ in the case of the "flame" under a certain environment based on the experiment by the inventors, while the ratio $W_L/W_H \leqq 3.0$ in the case of the "mercury lamp" and "the rotary lamp", and the "flame" can be correctly discriminated from other two cases by appropriately setting the threshold according to the experimental results and the environment. That is, the fire can be detected by setting the ratio to the prescribed threshold=4.0. In addition, the threshold may be automatically or manually changed so as to be adapted to the environmental condition, etc.

Figure 5:
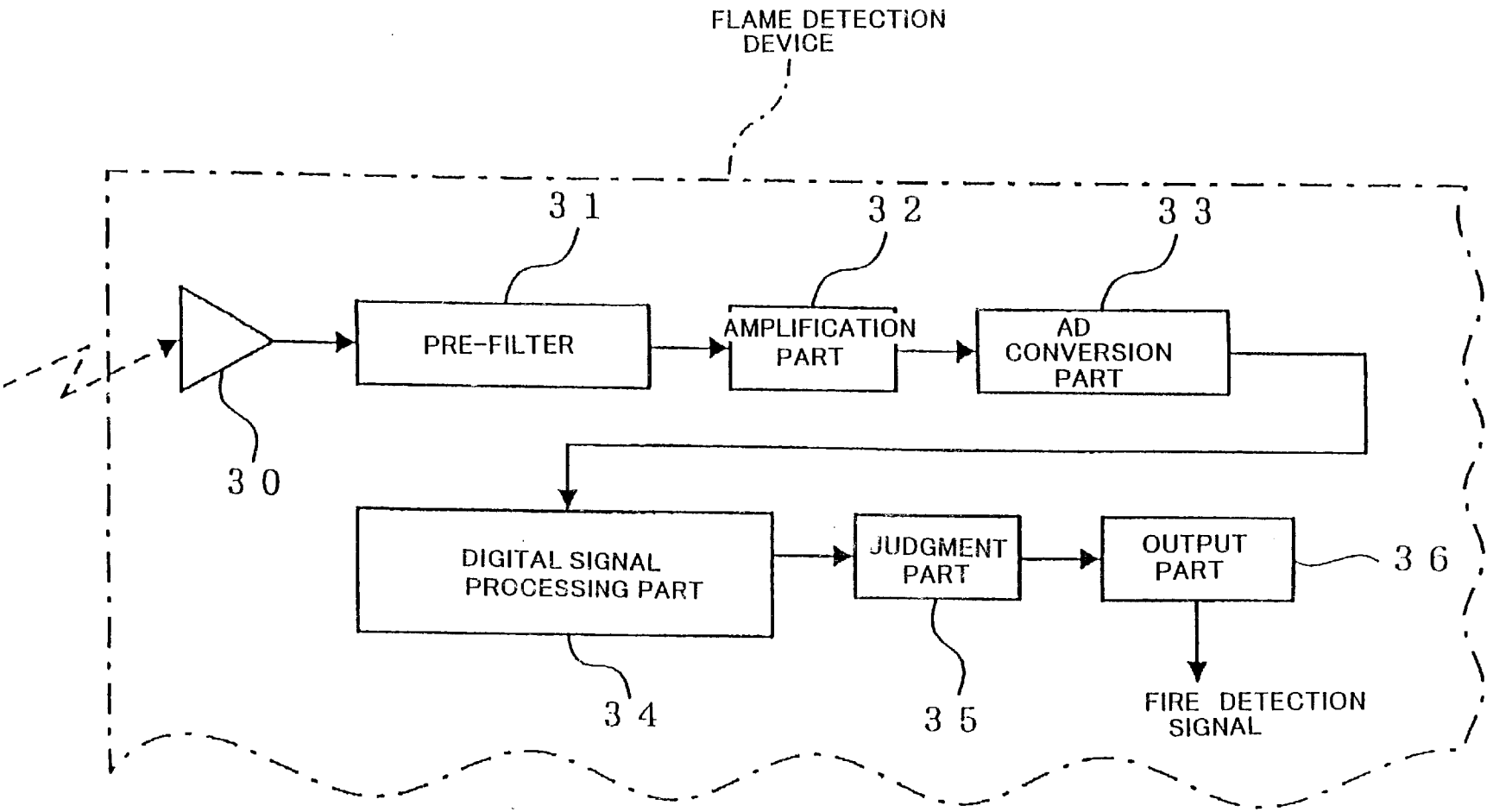
FIG. 5 is a conceptual diagram of a third embodiment.

Next, the third embodiment of the present invention shown in FIG. 5 is described.

The flame detection device of the present embodiment is provided with a detection element 30 similar to that in the above-mentioned embodiment, and also provided with at least a pre-filter 31 to cut the signal of the frequency range exceeding the above-mentioned second frequency range B, an amplification part 32 to amplify the output signal of the pre-filter 31, an AD conversion part 33 to convert the output signal of the amplification part 32 into the digital signal, a digital signal processing part 34 having the function equivalent to the first frequency filter 21 and the second frequency filter 22 in FIG. 4, a judgment part 35 to judge a fire based on the output signal of the digital signal processing part 34—each output signal of the first frequency filter 21 and the second frequency filter 22 in FIG. 4, i.e., the signal corresponding to the signal ($W_L$) of the first frequency range A and the signal ($W_H$) of the second frequency range B, and an output part 36 to output the fire detection signal according to the result of judgment of the judgment part 35.

The judgment part 35 judges a fire when the ratio of $W_L$ to $W_H$ ($W_L/W_H$) is within a range of the prescribed threshold similar to the above-mentioned condition of the second embodiment.

In this example of the embodiment, the function of two filters (equivalent to the first frequency filter 21 and the second frequency filter 22 in FIG. 4) it is important to take out the signal of the first frequency range A and the signal of the second frequency range B, is digitally realized. Thus, a remarkable advantage that the idealized filter characteristic can be easily formed, is obtained. These two filters correctly take out the signal of extremely low frequency (in the vicinity of 1.8 Hz and 2.5 Hz), but in practice, it is fairly difficult to design an analog filter with such a steep cut-off characteristic at such a low frequency. Also, used in the flame detection device are inexpensive, and even if a filter of the desired characteristic is manufactured, its employment is less possible. On the other hand, in the digitally realized filter, the desired filter characteristic can be easily obtained at low cost only by designing the software (program) if its realizing means is a data processing unit for general use, or by achieving the logical design if its realizing means is a programmable logic circuit. Thus, not only the above-mentioned signal of low frequency can be correctly ascertained, but also the DC part can be provided, and flame detection performance can be further improved.

More specifically, the signal in a range of 0–0.5 Hz, and the signal in a range of 0–1.0 Hz may be cut. When the signal in a range of 0–1.0 Hz is cut, the first frequency range of 0.5–8.0 Hz may be reset to the range on the upper side of the DC part to be cut, e.g., the range of 1.0–8.0 Hz.

Figure 6:
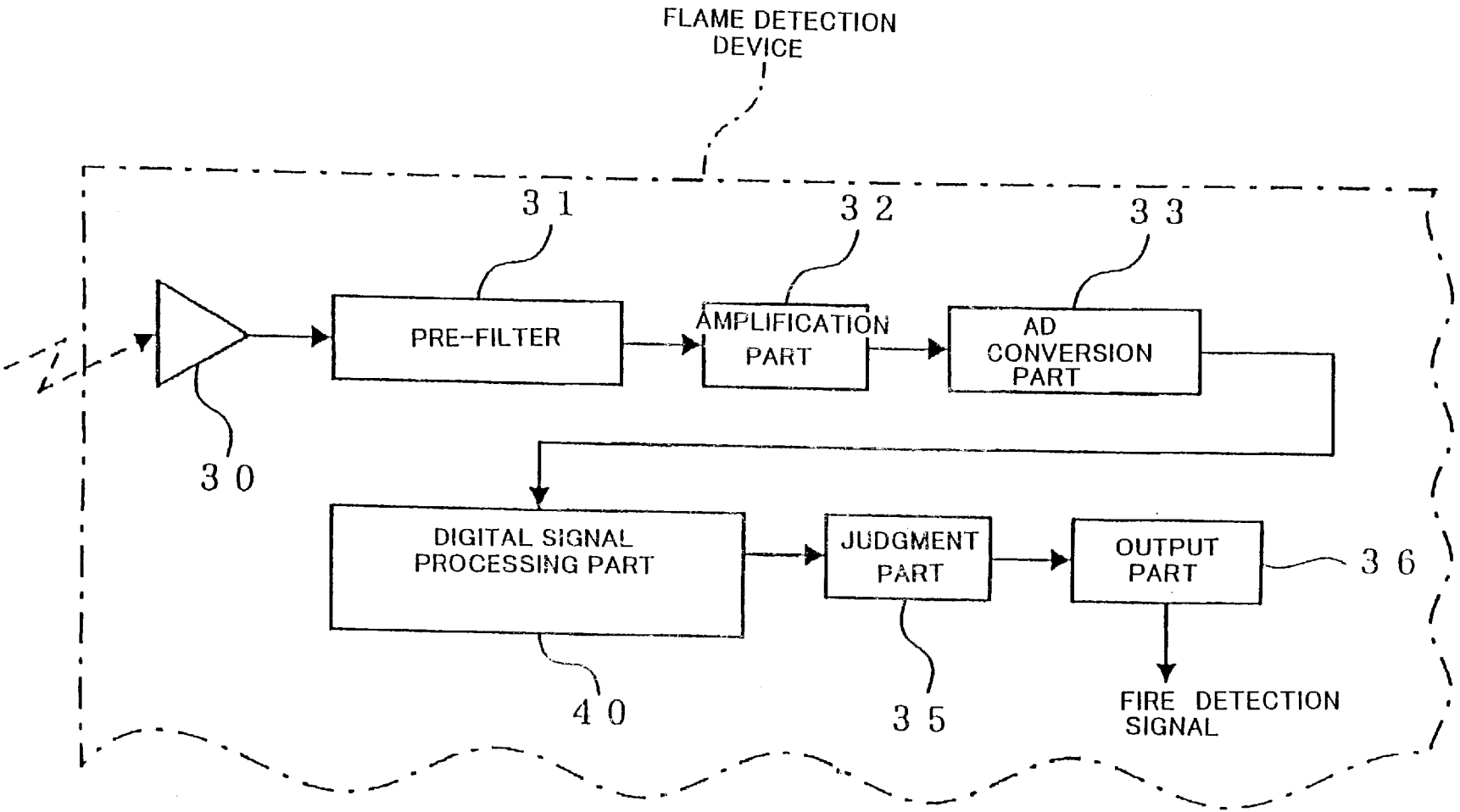
FIG. 6 is a conceptual diagram of a fourth embodiment.

The fourth embodiment of the present invention indicated in FIG. 6 is described.

The present embodiment is a modification of the above-mentioned third embodiment, and different in that a method of the Fast Fourier Transformation (FFT) is adopted in the digital signal processing part 40 so as to take out the signal of the first frequency range A and the signal of the second frequency range B. FFT is a calculation method in which the operational procedures in the discrete Fourier transformation operation are appropriately decomposed, and the number of calculation originally reaching around $N^2$ is reduced to around NlogN, taking into consideration the periodicity and symmetry of the series. The FFT is extensively used as the method to digitally analyze the frequency spectrum $X(\omega)$ of the non-periodic time function x(t). The effect similar to that of the above-mentioned third embodiment can also be obtained by using the FFT algorithm. Alternatively, the method of the Maximum Entropy Method (MEM) may be adopted to the digital signal processing part 40. MEM is a method to estimate the spectrum with higher resolution than that of FFT in a short time of measurement.

In the above-mentioned third and fourth embodiment, sampling of amplified signal is carried out by said AD conversion part 33. Or, a sampling part which samples a signal might be set up between the amplification part 32 and the AD conversion part 33.

Figure 7:
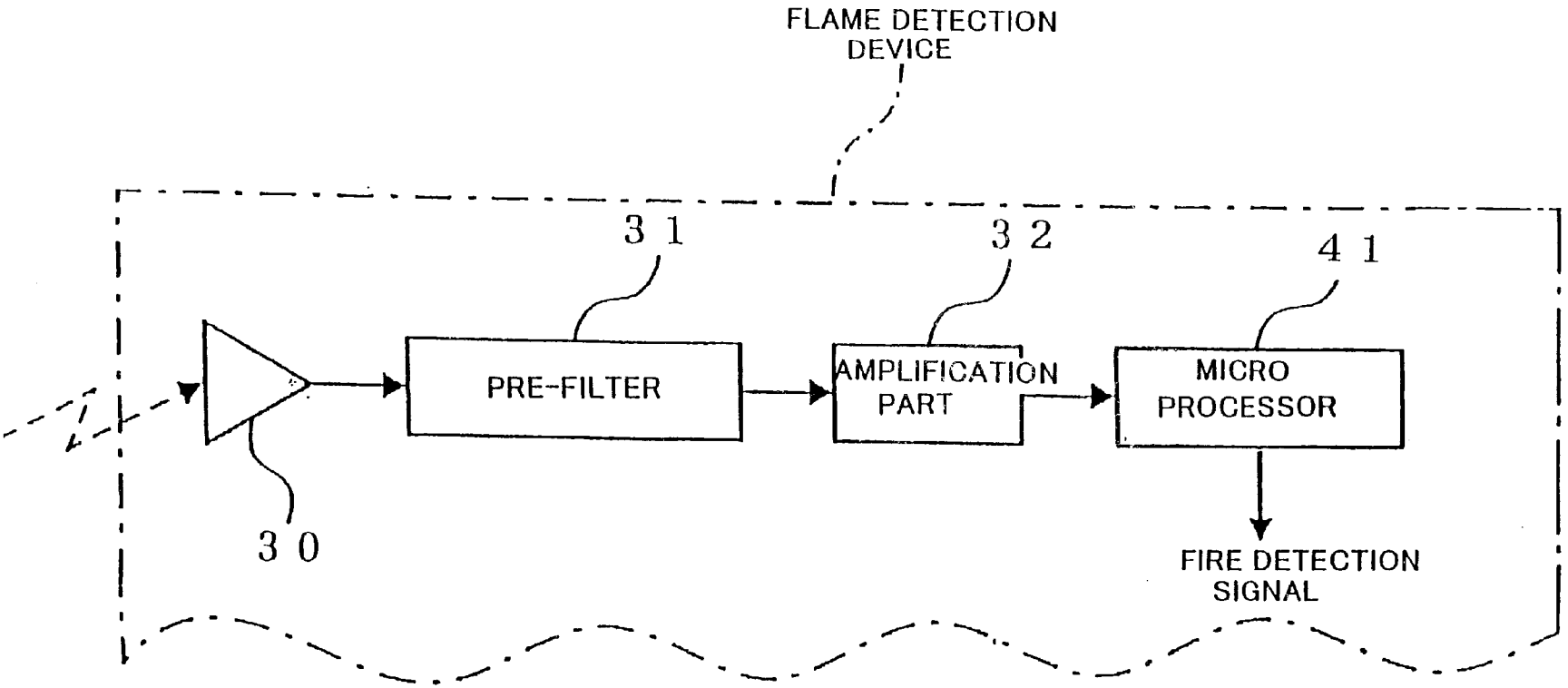
FIG. 7 is a conceptual diagram of a fifth embodiment.
Figure 8:
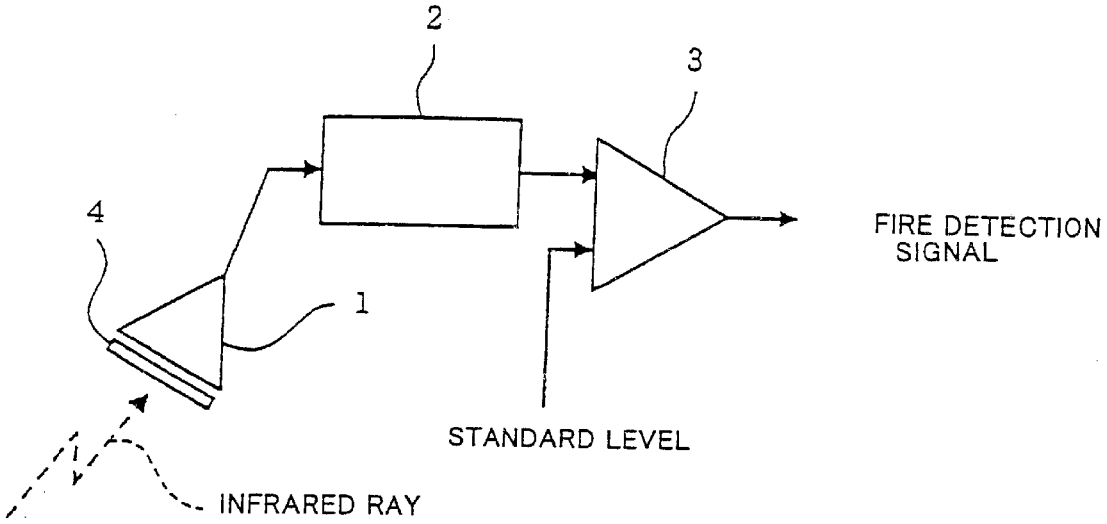
FIG. 8 PRIOR ART
FIG. 8 is a conceptual diagram of a conventional flame detection device.
Figure 9:
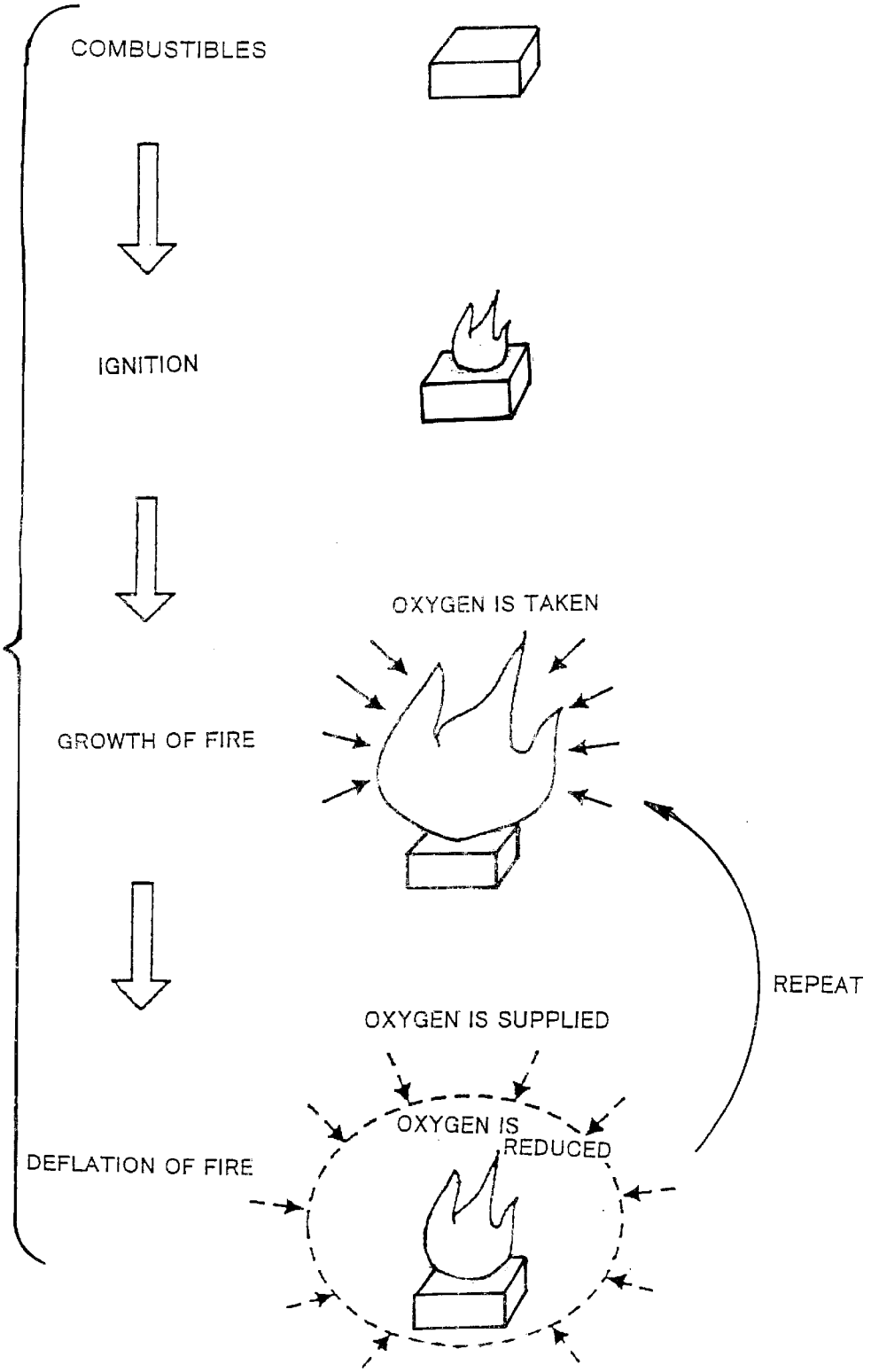
FIG.9 PRIOR ART
FIG. 9 is a schematic view of how a flame burns.
Figure 10:
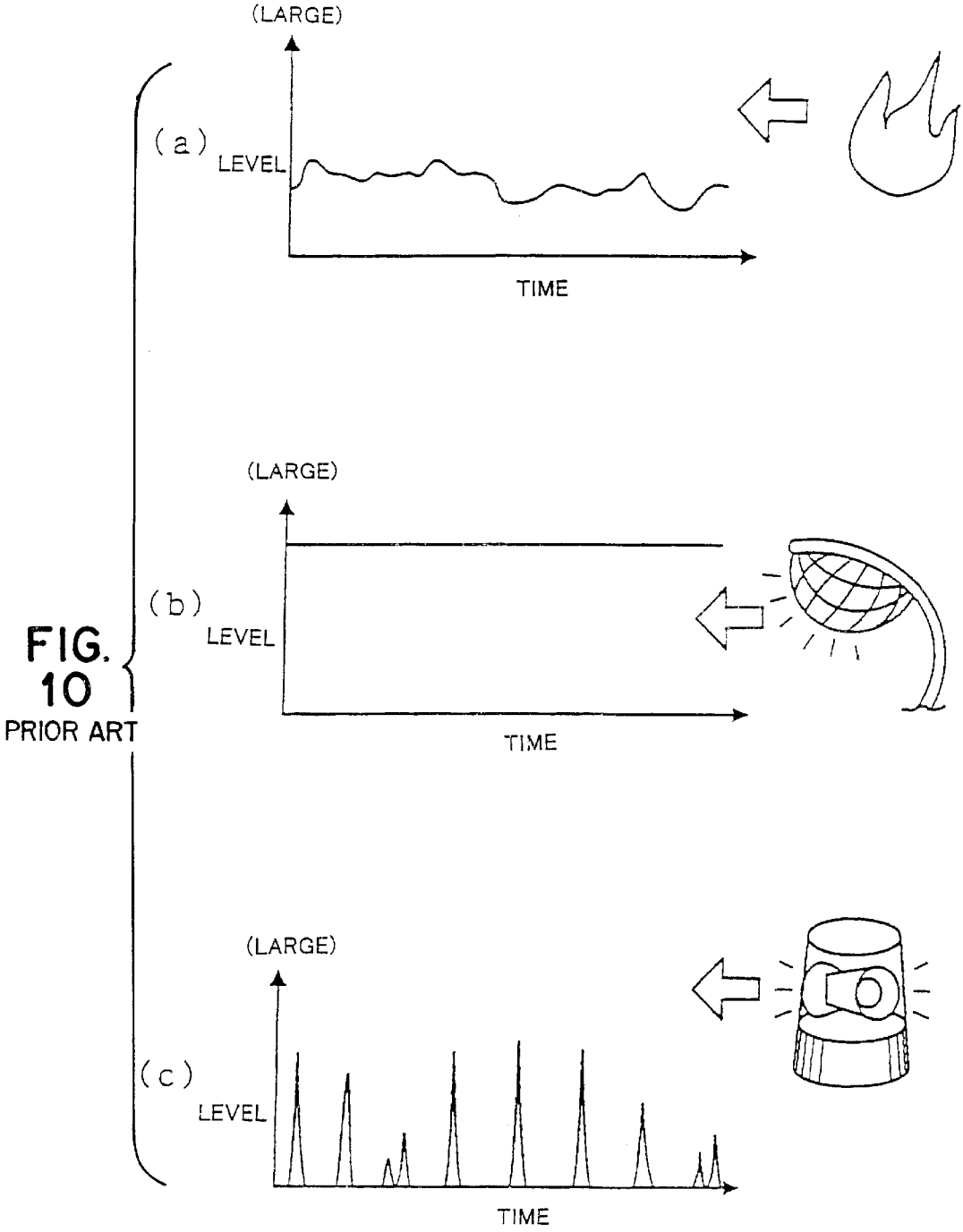
FIG. 10 PRIOR ART
FIG. 10 is a characteristic figure (time base) of an infrared ray energy radiation body including the flame.
Figure 11:
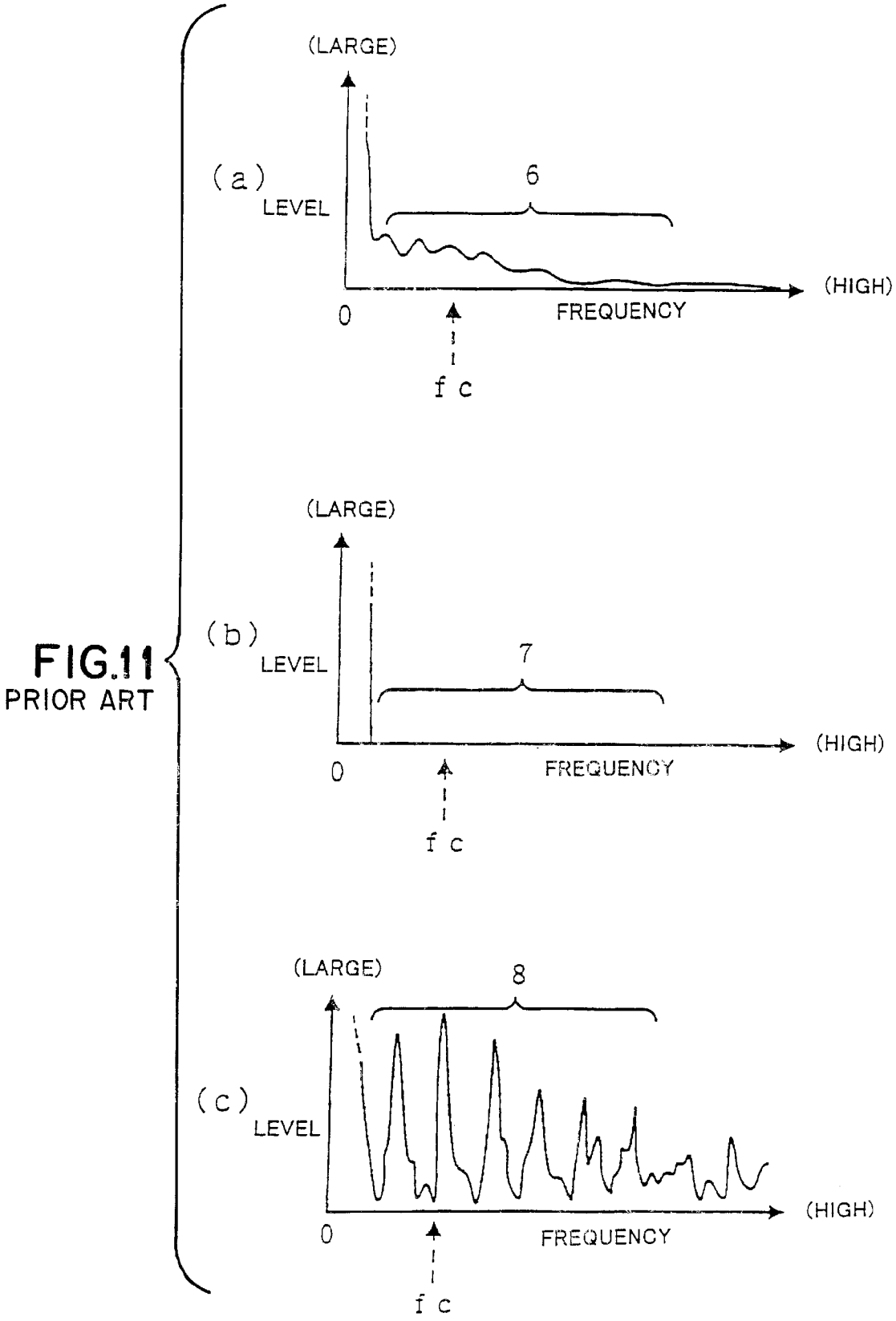
FIG.11 PRIOR ART
FIG. 11 is a characteristic figure (frequency base) of an infrared ray energy radiation body including the flame.

Next, the fifth embodiment of the present invention indicated in FIG. 7, is described.

The fifth embodiment is another modification of the fourth embodiment, and different in that an AD conversion part, a digital signal processing part (FFT operation part), a judgment part and an output part are collectively constitute by a micro processor 41. That is, in the fifth embodiment, sampling of amplified signal, the AD conversion of the sampled signal, the FFT operation, the fire judgment, and the output of the fire signal are achieved by the micro processor 41 and the program stored in a memory part which is not shown in the figure. The device can be made at a low cost in a relatively simple manner. The pre-filter 31 is also replaced by the function of the micro processor 41, but in this case, the signal including the frequency higher than that in the second frequency range is received by the amplification part 32, and the amplification part 32 can be saturated. Thus, the pre-filter 31 is independently arranged without replacement by the micro processor 41.

Next, some detection conditions of the third to fifth embodiments are now described. Table 1 shows detection conditions of case 1 and case 2. In setting for these conditions, a method of the FFT is adopted to analyze the frequency.

First, the condition setting, sampling time is considered. Because said flicker frequency of a general fire includes a frequency lower than 1 Hz, it is desirable that sampling be done over at least 2 seconds to catch the flicker frequency.

Secondly, the amount of sampling data is considered. It is usually requisite for FFT to sample an amount of data which are subjected to FFT. The more larger the amount of data obtained, the more the detection is accurate. However, if the amount of data is too much, excessive loads are imposed on the process part such as the micro processor 41 and it will take a long time to judge whether or not a fire exists. Based on experiments by applicant, it is requisite to sample at least 64 samples of data to obtain practical detection accuracy, but if the amount of data obtained is over 128 samples, excessive loads are imposed to micro processor 41. Thus, the amount of sampling data is preferably 64 to 128.

Next, sampling frequency is considered. As a premise, maximum frequency which can form frequency distribution is half of sampling frequency. On the other hand, frequency of a real fire is essentially distributed to a frequency lower than 8 Hz. Also, regarding an artificial light source (for example, the "rotary lamp") which has a repetitive cycle within such frequency lower than 8 Hz, there is at least one high harmonic frequency between 8 Hz to 16 Hz (regarding an artificial light source which has a repetitive cycle higher than 8 Hz, it can be judged as non-fire since frequency lower than 8 Hz is considered as small). Thus it is necessary that at least one high harmonic frequency of maximum frequency of the first prescribed frequency range A is included in the second prescribed frequency range B. Also, in this condition, it is necessary that width of the range B is the same as or over width of the range A. In other words, the range B has to include at least multiple harmonic frequency of each frequency of the range A. In consideration of the above, to distinguish a real fire from sources of false alarm, it is necessary that at least frequency of 0 to 16 Hz be detected, and therefore sampling frequency has to be more than 32 Hz. On the other hand since frequency over 32 Hz raises some problems such as low response of detect elements and noise of AC batteries, sampling frequency is preferably 32 Hz. This way of consideration of sampling frequency is adopted for the first and second embodiments too.

Based on the consideration as mentioned above and relationship as sampling frequency=amount of sampling data/sampling time, two suitable conditions can be set as shown in Table 1. In the condition of case 1, sampling time=2 sec, sampling frequency=32 Hz and amount of sampling data=64. In the condition of case 2, sampling time 4 sec, sampling frequency=32 Hz and amount of sampling data=128.

Also, a frequency pitch (a frequency resolving power), which is obtained as a result of the FFT, is an inverse number of sampling time. Thus, the pitch=0.5 Hz in case 1 and the pitch=0.25 Hz in case 2.

Next, elimination of some values of frequency is considered. First value (value of 0 Hz) of result of FFT includes frequency which corresponds to direct current and the first value is larger than other values. Thus, difference between the signal level integrated value of the range B (which is between 8 Hz and 16 Hz in the above condition) and the integrated value of the range A (which is lower than 8 Hz in the above condition) would be unclear. Therefore, it is preferable to eliminate the first value from the result of FFT to be clear of the difference. Also, this elimination brings another effect that frequency of artificial light source without fluctuation (for example, the "mercury lamp") would be about 0 Hz in each frequency (includes frequency lower than 8 Hz except for the first value).

Based on the consideration, in condition of case 1, a lowest frequency 0.5 Hz except for the first value is set to $f_{CL1}$. Also, based on the above consideration of frequency distribution, 8 Hz and 16 Hz are set to $f_{CH1}$ and $f_{CH2}$ respectively. Also, $f_{CH1}$ and frequency pitch make $f_{CL2}$ as 8.5 Hz.

Based on the same reason, in condition of case 2, 0.25 Hz, 8 Hz, 8.25 Hz and 16 Hz are set to $f_{CL1}$, $F_{CH1}$, $f_{CL2}$, $f_{CH2}$ respectively.

Second value (1 frequency pitch from the first value, namely, 0.5 Hz in condition of case 1, and 0.25 Hz in condition of case 2 ) might be very larger than other values too, depending on sampling frequency and amount of sampling data etc. In such a case, it is preferable to eliminate the second value too. Thus, 1.0 Hz is set to $f_{CL1}$ in condition of case 1, and 0.5 Hz is set to $f_{CL1}$ in condition of case 2.

It is preferable to the above processes, such as FFT, started after sampling value is larger than predetermined level to lighten process loads and power consumption of signal processing part, judgment part, micro processor etc.

TABLE 1

| | Detection Condition of Case 1 | Detection Condition of Case 2 |
|---|---|---|
| Sampling Time (sec) | 2 | 4 |
| Sampling Frequency (Hz) | 32 | 32 |
| Amount of Sampling Data | 64 | 128 |
| Frequency Pitch after FFT (Hz) | 0.5 | 0.25 |
| $f_{CL1}$ | 0.5 | 0.25 |
| $f_{CH1}$ | 8 | 8 |
| $f_{CL2}$ | 8.5 | 8.25 |
| $f_{CH2}$ | 16 | 16 |

What is claimed is:

1. A flame detection device comprising:

a detection element to convert the infrared ray energy into the electrical signal;

a first extracting means to extract the representing signal which represents total energy of the first prescribed frequency range including the flicker frequency of the infrared ray energy of the flame from the output signal of said detection element;

a second extracting means to extract the representing signal which represents total energy of the second prescribed frequency range including no flicker frequency fc of the infrared ray energy of the flame, but including the frequency on the higher frequency side than the first prescribed frequency range from the output signal of said detection element; and a judging means to judge whether or not a fire is generated based on a result of comparing the output signal of said first extracting means with the output signal of said second extracting means when the output signal of said first extracting means is larger than the output signal of said second extracting means by a prescribed value.

2. A flame detection device according to claim 1, wherein generation of a fire is judged when the representing signal extracted by said first extracting means has the level of not less than a first prescribed value in said judging means, and the representing signal extracted by said second extracting means does not have the level of not less than a second prescribed value.

3. A flame detection device according to claim 1, wherein generation of a fire is judged when the ratio of the representing signal extracted by said first extracting means to the representing signal extracted by said second extracting means exceeds a third prescribed value.

4. A flame detection device according to claim 1, wherein said first extracting means and said second extracting means may analyze the frequency of sampling data of the signal from said detection element sampled with the prescribed sample frequency and analyzes a frequency element, then extract an integrated signal level as the representing signal, using a digital filter, a Fast Fourier Transformation method, or a maximum entropy method.

5. A flame detection device according to claim 1, wherein said first prescribed frequency range is set up to include no DC part of the output signal of said detection element.

6. A flame detection device according to claim 1, wherein said second prescribed frequency range includes at least multiple harmonic frequency of each frequency of said first prescribed frequency range.

7. A flame detection device according to one of claims 1 to 6, wherein said first prescribed frequency range is 0.5 Hz to 8.0 Hz, and said second prescribed frequency range is 8.5 Hz to 16.0 Hz.

8. A flame detection device according to one of claims 1 to 6, wherein said first prescribed frequency range is 0.25 Hz to 8.0 Hz, and said second prescribed frequency range is 8.25 Hz to 16.0 Hz.

9. A flame detection device comprising:

a detection element to convert the infrared ray energy into the electric signal;

a first extracting means to extract the representing signal which represents total energy of a first prescribed frequency range of 0.5 Hz to 8.0 Hz including no DC part of said output signal but including the flicker frequency fc of the infrared ray energy of the flame from the output signal of said detection element by the Fast Fourier Transformation method;

a second extracting means to extract the representing signal which represents total energy of a second prescribed frequency range of 8.5 Hz to 16.0 Hz including no flicker frequency fc of the infrared ray energy of the flame, but including the frequency on the higher frequency side than that of said first prescribed frequency range from the output signal of said detection element by the Fast Fourier Transformation method; and a judging means that a fire is generated when the representing signal extracted by said first extracting means has the level of not less than the first prescribed value, and the representing signal extracted by said second extracting means does not have the level of not less than the second prescribed value.

10. A flame detection method comprising:

a first step to extract the representing signal of the first prescribed frequency range including the flicker frequency fc of the infrared ray energy of the flame and the signal of the second prescribed frequency range including no flicker frequency fc of the infrared ray energy of the flame, but including the frequency on the higher frequency side than that of said first prescribed frequency range from the output signal of the detection element to convert the infrared ray energy into the electric signal; and a second step to judge whether or not a fire is generated based on a result of comparing two signals extracted in said first step when said extracted signal is larger than said second extracted signal by a prescribed value.

11. A flame detection method according to claim 10, wherein generation of a fire is judged when the representing signal of the first prescribed frequency range extracted in said first step has the level of not less than a fire prescribed value, and the representing signal of the second prescribed frequency range extracted in said first step does not have the level of not less than a second prescribed value in said second step.

12. A flame detection method according to claim 10, wherein generation of a fire is judged when the ratio of the representing signal of the first prescribed frequency range extracted in said first step to the representing signal of the second prescribed frequency range exceeds a predetermined value.

13. A flame detection method according to claim 10, wherein the frequency of the signal of sampling data of the output signal sampled with prescribed sampling frequency is analyzed, and then the representing signal is extracted using a digital filter, a Fast Fourier Transformation method or a maximum entropy method in said first step and said second step.

14. A flame detection method according to claim 10, wherein said first prescribed frequency range is set up to include no DC part of the output signal of said detection element.

15. A flame detection method according to claim 10, wherein said second prescribed frequency range includes at least multiple harmonic frequency of each frequency of said first prescribed frequency range.

16. A flame detection method according to one of claims 10 to 15, wherein said first prescribed frequency range is 0.5 Hz to 8.0 Hz, and said second prescribed frequency range is 8.5 Hz to 16.0 Hz.

17. A flame detection method according to one of claims 10 to 15, wherein said first prescribed frequency range is 0.25 Hz to 8.0 Hz, and said second prescribed frequency range is 8.25 Hz to 16.0 Hz.

18. A flame detection method comprising:

a first step to extract the representing signal of a first prescribed frequency range of 0.5 Hz to 8.0 Hz including no DC part of the output signal but including the flicker frequency fc of the infrared ray energy of the flame and the representing signal of a second prescribed frequency range of 8.5 Hz to 16.0 Hz including no flicker frequency fc of the infrared ray energy of the flame but including the frequency on the higher frequency side than that of said first prescribed frequency range from the output signal of a detection element to convert the infrared ray energy into the electric signal by the Fast Fourier Transformation method; and a second step to judge that a fire is generated when the representing signal of a first prescribed frequency range extracted in said first step has the level of not less than the first prescribed value, and the representing signal of the second prescribed frequency range extracted in said first step does not have the level of not less than the prescribed value.

19. A flame detection method comprising:

a first step to extract the representing signal of a first prescribed frequency range including the flicker frequency fc of the infrared ray energy of the flame and the representing signal of a second prescribed frequency range including no flicker frequency fc of the infrared ray energy of the flame and including the frequency on the higher frequency side than that of said first prescribed frequency range from the output signal of a detection element to convert the infrared ray energy into the electric signal and a second step to judge that a fire is generated when the representing signal of the second prescribed frequency range extracted is obtained, and said representing signal level is lower than the representing signal of the first prescribed frequency range.

* * * * *